US005125580A

United States Patent [19]

Kronberger

[11] Patent Number: 5,125,580

[45] Date of Patent: Jun. 30, 1992

[54] FUEL INJECTION NOZZLE

[75] Inventor: Maximilian Kronberger, Steyr, Austria

[73] Assignee: Voest-Alpine Automotive Gesellschaft, m.b.H., Linz, Austria

[21] Appl. No.: 613,651

[22] PCT Filed: Jan. 12, 1990

[86] PCT No.: PCT/AT90/00005

§ 371 Date: Nov. 7, 1990

§ 102(e) Date: Nov. 7, 1990

[87] PCT Pub. No.: WO90/08256

PCT Pub. Date: Jul. 26, 1990

[30] Foreign Application Priority Data

Jan. 12, 1989 [DE] Fed. Rep. of Germany ..... 3900762
Jan. 12, 1989 [DE] Fed. Rep. of Germany ..... 3900763

[51] Int. Cl.[5] ..... F02M 47/00
[52] U.S. Cl. ..... 239/533.4; 239/533.8
[58] Field of Search ..... 239/88-92, 239/533.1-533.9

[56] References Cited

U.S. PATENT DOCUMENTS 4,576,338 3/1986 Klomp ..... 239/533.3
4,624,135 11/1986 Bungay et al. ..... 239/533.3
4,840,310 6/1989 Haider ..... 239/533.4

FOREIGN PATENT DOCUMENTS 2086473 5/1982 United Kingdom .
8402379 6/1984 World Int. Prop. O. .

*Primary Examiner*—Andres Kashnikow
*Assistant Examiner*—Lesley Morris
*Attorney, Agent, or Firm*—Cushman, Darby & Cushman

[57] ABSTRACT

In a fuel injection nozzle, particularly pump jet, with a nozzle plunger (3) that is spring-loaded in the closing direction, whereby the nozzle plunger (3) extends, at its end turned away from the spray openings, into a damping chamber (28) that can be filled with fuel and has a pressure pin (23), which is surrounded with a stabilized projection (26) that forms a stop for a shoulder (22) of the nozzle plunger (3) and whereby the stable wall of the damping chamber (28), during the stroke movement of the nozzle plunger (3), defines, with the pressure pin (23), a throttle opening, which opens into a drain (11) and/or another chamber (12), the throttle opening cross section is largest at the beginning of the stroke, whereby an optimum and precisely reproducible injection curve can be achieved.

5 Claims, 3 Drawing Sheets

FUEL INJECTION NOZZLE

Figure 1:
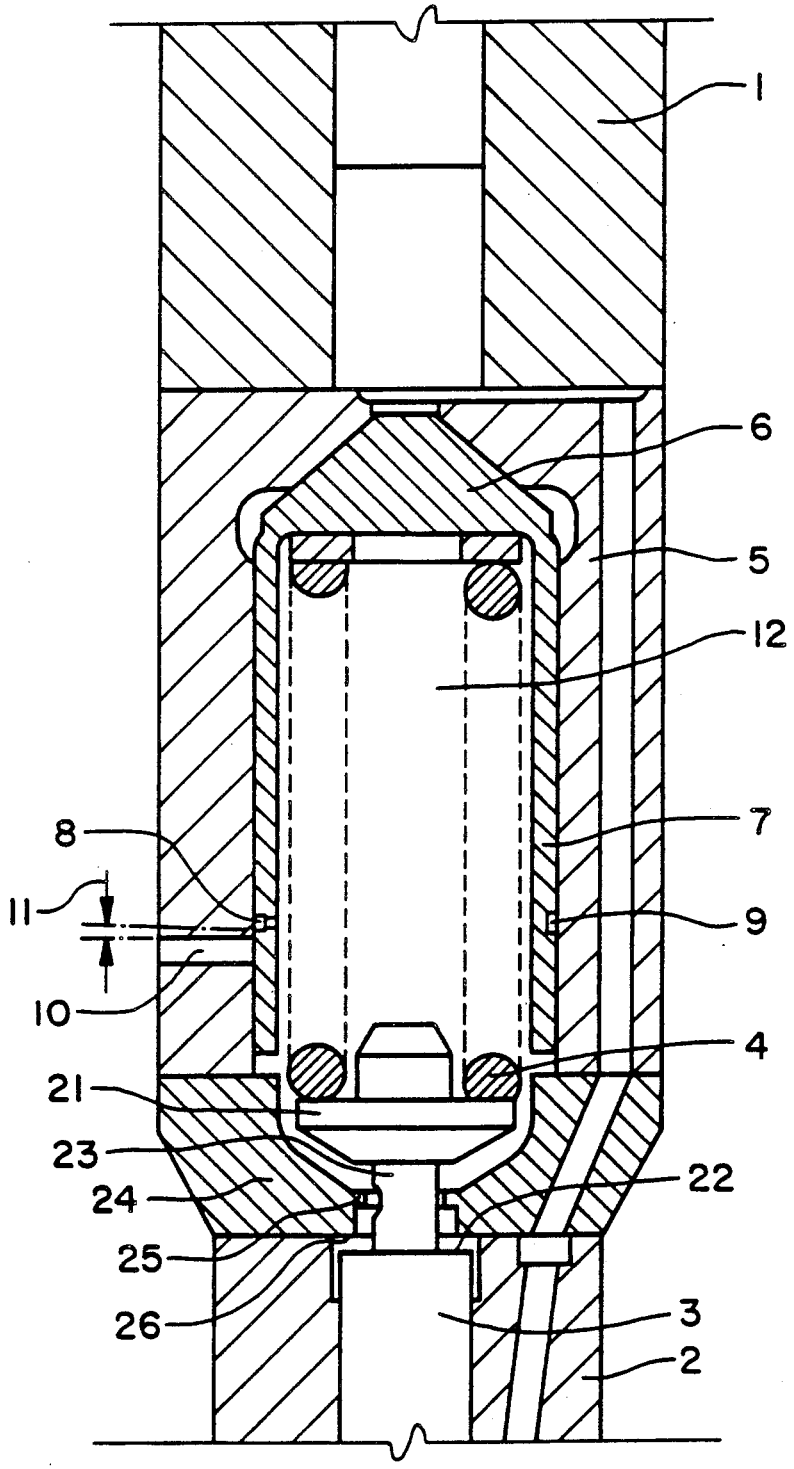

The invention relates to a fuel injection nozzle, particularly a pump jet with a nozzle plunger that is spring-loaded in the closing direction, whereby the nozzle plunger extends, with its end turned away from the spray openings, into a damping chamber that can be filled with fuel and has a pressure pin that is surrounded with a stabilized projection that forms a stop for one shoulder of the nozzle plunger and whereby the stabilized wall of the damping chamber, during the stroke movement of the nozzle plunger, defines a throttle opening, which opens into a drain and/or another chamber.

In EP-A 267 177 and EP-A 277 939, fuel injection nozzles are described which make possible the division of the injection process into a pilot injection and a main injection by the use of a shunting piston. The very difficult problem of insuring a practical injection process under different operating conditions is solved in principle there by the damping of the shunting piston motion, but a few inconveniences still exist.

In a pump jet according to the state of the art, malfunctions in the injection process are observed relatively frequently. Sometimes the shunting piston opens too late, sometimes the pilot injection starts too late and supplies a quantity that is too low, sometimes it is omitted entirely. It is assumed that these malfunctions develop because of statistical variation in the pump supply pressure curve and in the dynamic opening pressure of the valve needle, e.g. if the valve needle has not opened yet when the dynamic opening pressure of the shunting piston is attained. An increase in this opening pressure would help, but is not possible, because the pilot injection would then last too long. This could only be achieved by a weaker damping of the shunting piston; however, because of that, the pilot injection quantity at low rpm would again be too low or at high rpm too high. The latter is undesirable for reasons of combustion dynamics and it also occurs already without increasing the dynamic opening pressure of the shunting piston. At high speed and full throttle, the pilot injection continues on into the main injection without an injection pause.

Since when the nozzle plunger is raised, the volume in the pressure chamber increases suddenly, at low speed, the injection pressure first decreases so that with a low dynamic opening pressure of the shunting piston for the reasons named above, the pilot injection quantity is too low.

To optimize the combustion curve, however, it is desirable that the pilot injection quantities are as close as possible to equal at all engine speeds and load conditions and the duration of the pilot injection and the injection pause in degrees crankshaft is as close as possible to equal at all engine speeds.

These ideal conditions are described as the combustion process in DE-OS 37 35169, but without any information on realizing them.

In principle, a subdivision of the injection process into a pilot injection and main injection has been already implemented with nozzles having nozzle plungers that work together across their stroke with two different springs. The disadvantages, of such so-called two-spring nozzle plunger brackets is the situation where the moved weights become greater and two springs with different spring characteristics result in a system that can vibrate. The effort for adjusting this type of equipment is thus relatively high and the separation into pilot injection and main injection can not always be reproduced over the engine speed curve.

The goal of the invention is to permit an exact separation into pilot injection and main injection with a simple design of the injection nozzle and particularly to maintain a high measure of precision and reproducibility over the entire engine speed range with small stroke and low moved weights. All in all, the goal of the invention is to create a simple injector nozzle which permits achievement of an optimum course of injection over time. To solve this task, the fuel injector nozzle of the type mentioned above according to the invention consists basically of the fact that the cross section of the throttle opening is largest at the start of the stroke. Because of the throttle opening between nozzle plunger spring chamber wall and pressure plate, at low engine speed, an especially abrupt drop in injection pressure is decreased by the opening of the nozzle plunger, which leads to an increase in the injection quantity in the first phase of the pilot injection. Because of the fact that the throttle opening cross section is largest at the beginning of the stroke, a rapid opening movement and in countermovement a rapid closing movement of the nozzle plunger is achieved, whereby even at high engine speeds an exact separation of pilot injection and main injection can be achieved. The injection curve can then be adapted to a time curve that can be selected and the adjustment jobs are reduced to a minimum, since the injection curve is determined according to design by the structure of the throttle opening cross section. The throttle opening cross section between pressure pin and stable wall of the damping chamber can thereby decrease continuously or in several stages with increasing stroke of the nozzle plunger, as corresponds to a preferred embodiment, whereby an adaptation to the currently required time curves can be achieved.

In a manner that is particularly simple with respect to production technology, the design can be made such that the pressure pin has a chamfer or recess, which defines a throttle opening of variable cross section with the stable wall of the damping chamber, across the length of the nozzle plunger stroke. In this way, with little production technology effort, a high measure of precision can be achieved. The desired variable throttle opening can be implemented in a particularly simple way, in that the recess has a triangular or trapezoidal cross section, and that the surfaces of the recess slanted toward the long axis of the nozzle plunger form a variable angle with the long axis, whereby in the sense of the task, it is particularly advantageous if the stable wall of the damping chamber has a narrow throttle lip and/or a throttle edge limited by two side surfaces running at an acute angle to each other. In all these cases, a cross section curve of the throttle opening is assured, in which the lowest damping occurs at the start of the nozzle stroke. The stroke movement of the nozzle plunger is thus delayed in the pilot injection phase after a first stroke range, after which a correspondingly quicker and shorter closing stroke can be completed at the pilot injection. The asymmetrical structure of a throttle of this type or of the pressure pin supplies the desired progressive throttle effect.

A particularly advantageous structure adapted to the desired injection curve then results if the design is such that the throttle opening cross section surface corresponds to 1/25 to 1/500, particularly 1/50 to 1/200, of the shoulder surface, whereby preferably the drain is connected with the pump intake chamber and the damping chamber is in a throttled connection with the fuel pressure chamber in front of the nozzle. plunger seat.

Figure 2:
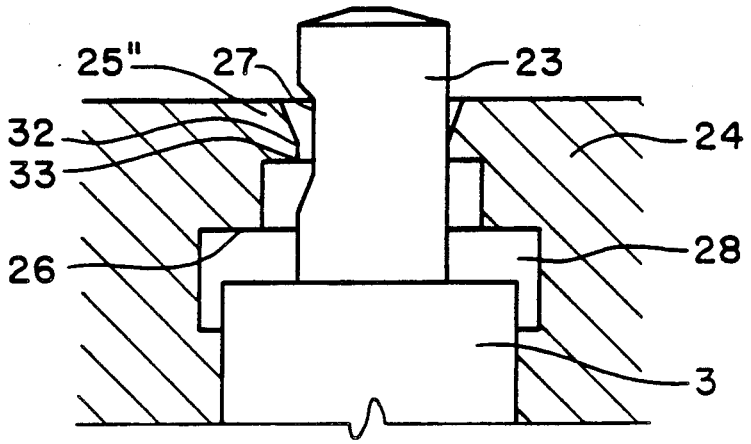
Figure 3:
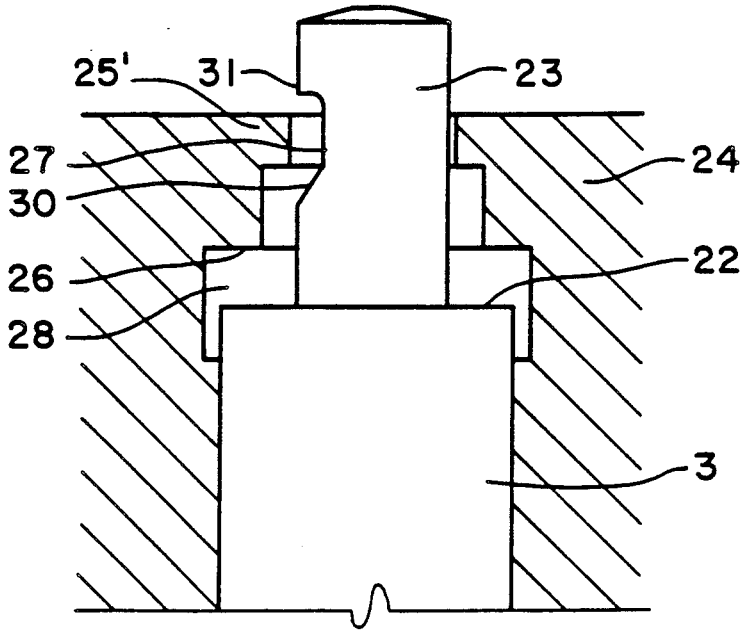
Figure 4:
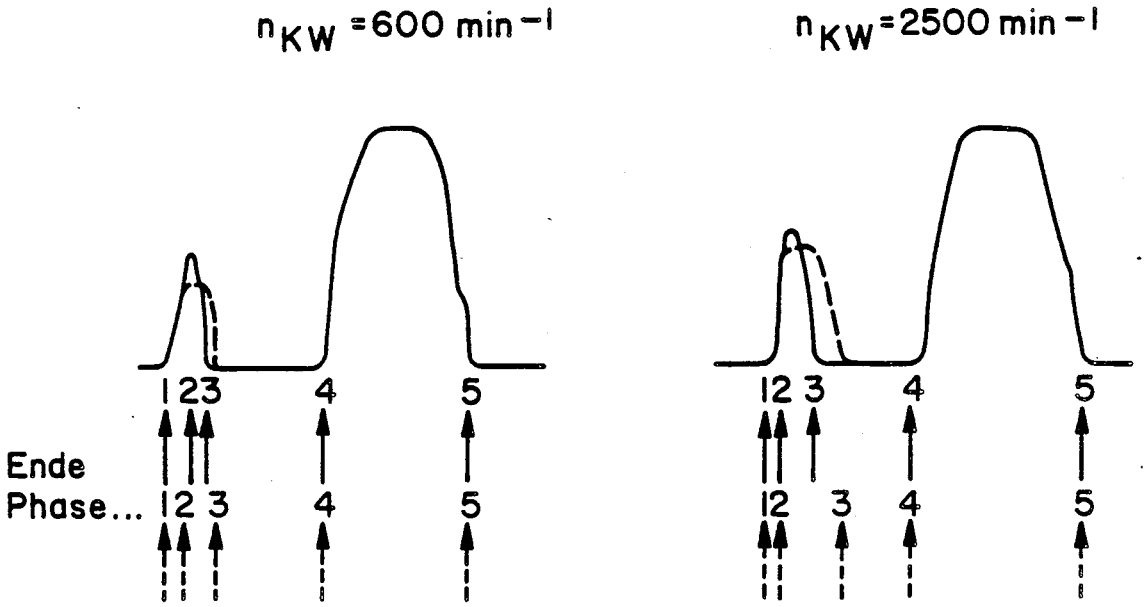

The invention is explained in more detail in the following using the embodiments of a fuel injection nozzle according to the invention schematically represented in the drawings. In these, FIG. 1 shows a longitudinal cross section through the center part of a fuel injection nozzle according to the invention;

FIG. 2 is an enlarged view of a portion of the nozzle shown in FIG. 1;

FIG. 3 a variation of the structure shown in FIG. 2; and FIG. 4 illustrates the injection rate curve at different engine speeds.

In the layout according to FIG. 1, 1 represents the pump piston bushing, 2 the nozzle body with nozzle plunger 3, and 4 the nozzle plunger spring, which is mounted in a spring housing 5. 6 is a shunting piston for dividing the injection process into a pilot injection and main injection.

The shunting piston 6 has a shroud 7 surrounding the nozzle plunger spring 4, which has a control opening 8 and if necessary a control groove 9, which works together with the opening 10 of the spring housing 5. Because of the special structure of the shunting piston, it is especially light and its inertial mass is thus low. The control opening 8 releases opening 10 only after a starting stroke 11 of the shunting piston. Until then, the volumetric elasticity of the fluid in spring chamber 12 works as a damper.

In spring housing 5, the nozzle plunger spring 4 creates a force connection between the shunting piston 6 and a spring plate 21. The latter is supported on the nozzle plunger 3. Only the upper part of this is shown, which consists, of a stop shoulder 22, to which a pressure pin 23 is connected. This pressure pin 23 goes through an intermediate plate 24, that has a stable projection 26 on the bottom and on top a throttle lip 25. The stable projection 26 works together with the stop shoulder 22 and the throttle lip 25 limits a throttle cross section with a chamfer 27 of pressure pin 23, as is shown in more detail in FIGS. 2 and 3. With the upward motion of the nozzle plunger 3, the fuel is pressed out of the damping chamber 28 between throttle lip 25 and chamfer 27, whereby the throttling that is important for solving the task occurs.

In the version in FIG. 1, the position of the chamfer and/or recess 27 is selected in such a way that the damping effect is the lowest in the position shown at the beginning of the nozzle plunger motion and then increases. Further below, two variations are described for this throttle point design.

FIG. 3 shows a variation of the nozzle plunger stroke damping. The throttle lip 25' is designed with a cylindrical inner edge and the chamfer 27 of the pressure pin 23 is asymmetrical. The transition 30 forms a sharp curve, while transition 31 is smooth. Because of this, the throttle effect depends on the direction of movement and on the actual nozzle plunger stroke. During the closing of the nozzle plunger, damping is not desirable, whereby this is assured by the largest throttle opening cross section at the beginning of the stroke. Because of cavitation danger for chamber 28, it can even cause damage.

In the variation in FIG. 2, the same effect is achieved in a different way. The chamfer 27 of pressure pin is basically trapezoidal and the throttle lip 25'' is limited on one side by plane 33 and on the other by ball surface 32.

Instead of the trapezoidal chamfer or recess 27 a basically triangular design can also be selected, whereby the desired variable throttle cross sections can be assured by variably slanted surfaces in the designs shown of throttle lip 25' and 25''. The cross section surfaces of the throttle locations thus are maximum 1/25 and minimum 1/500 of base surface 15 and/or the surface of shoulder 22.

In the construction of the throttle points, there is great freedom in the scope of the invention, to adjust the throttle behavior by easy technical measures and to make it dependent on the stroke and/or on the direction of movement. It is naturally also possible to give pressure pin 23 a shape with rotational symmetry, leaving off the chamfer 27.

In the following, using the diagrams in FIG. 4, comparisons will be made of the injection quantity curves in a pump jet at idle and at high rpm according to the state of the art (dotted line) and a pump jet according to the invention. The injection process is divided into several phases:

Phase 1: Beginning of the pump stroke until the dynamic opening pressure of the nozzle plunger is attained, no supply, Phase 2: end of phase 1 until the dynamic opening pressure of the shunting piston is achieved, Phase 3: end of phase 2 until the nozzle plunger closes, Phase 4: injection pause, until the dynamic opening pressure of the nozzle plunger is achieved again, Phase 5: the subsequent main injection.

At low engine speed, the main difference between the state of the art and the object of the invention is in Phase 3. It can be seen that with similar form of the pressure curve, the drop in quantity occurs earlier and more steeply because of the high closing speed that can be achieved by variable damping of the nozzle plunger, which would lead to a slight reduction in pilot injection quantity.

At high engine speed, the difference is also in Phase 3. Because of the steeper pressure drop, the decrease in injection quantity is steeper, whereby a significant reduction in pilot injection quantity is achieved. The improved closing characteristic of nozzle plunger 3 leads to a short pilot injection and a subsequent defined injection pause. This effect is achieved by the damping that is variable via the stroke, in which the large throttle opening at the beginning of the nozzle plunger stroke leads to a quick and limited opening of the nozzle plunger during the pilot injection, whereby a small closing path results.

To achieve the desired injection curve, the throttle opening cross section between pressure pin 23 and the stable wall of the damping chamber 28 can be changed continuously or in stages with increasing stroke of the nozzle plunger 3. These varying options result from the cooperation of the recesses and/or chamfers 27 shown as examples in FIGS. 2 and 3 of pressure pin 23 as well as the step-shaped or wedge-shaped throttle lips 25' and 25''. Because of the variable structure of the slants of the cylinder and/or ball surfaces that create the recess and/or chamfer 27 or the throttle edges, a change in the throttle effect also occurs depending on the direction of flow, because of the more or less heavily separated flow that depends on the slant of the forming parts. By suitable selection of the slants, a rapid opening of nozzle plunger 3 at the beginning of the stroke and an almost undamped closing of the nozzle plunger 3 can be achieved in this way for an exact ending of the injection phase.

I claim:

1. A fuel injection nozzle, comprising:

a nozzle plunger which is spring-loaded towards a closed position, said plunger extending at one of its ends into a damping chamber adapted to be filled with fuel;

a pressure pin joined to said plunger end and projecting through an opening of said damping chamber, said opening defining a stop for limiting movement of the plunger against the loading of said spring;

said damping chamber including a wall which, together with the pressure pin, define a throttle opening which decreases in cross-section as said nozzle plunger moves against the loading of the spring, the throttle opening cross-section being largest at the beginning of nozzle plunger movement.

2. A fuel injection nozzle according to claim 1, wherein said pressure pin includes a recess positioned on the pin at a location which causes the throttle opening to change in cross-section as said nozzle plunger moves.

3. A fuel injection nozzle according to claim 1 or 2, wherein said damping chamber wall includes a lip which cooperates with the pressure pin to define the throttle opening cross-section.

4. A fuel injection nozzle according to claim 3, wherein said lip is defined by said surface which is at an acute angle with respect to a longitudinal axis of the pressure pin.

5. A fuel injection nozzle according to claim 1 or 2, wherein the throttle opening cross-section is 1/50 to 1/200 of the area of said step for limiting plunger movement.

* * * * *